US006659089B2

(12) United States Patent
Gokan et al.

(10) Patent No.: US 6,659,089 B2
(45) Date of Patent: Dec. 9, 2003

(54) TURBOCHARGER ARRANGEMENT STRUCTURE FOR PERSONAL WATERCRAFT

(75) Inventors: Yoshitsugu Gokan, Saitama (JP); Kazunori Okada, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/173,863

(22) Filed: Jun. 19, 2002

(65) Prior Publication Data

US 2003/0015182 A1 Jan. 23, 2003

(30) Foreign Application Priority Data

Jul. 19, 2001 (JP) ..... 2001-219321

(51) Int. Cl.[7] ..... F02B 33/00
(52) U.S. Cl. ..... 123/559.1; 60/605.1
(58) Field of Search ..... 60/605.1; 123/559.1

(56) References Cited

U.S. PATENT DOCUMENTS 4,760,704 A * 8/1988 Torigai ..... 60/612
4,827,722 A * 5/1989 Torigai ..... 60/599
6,352,068 B1 * 3/2002 Jacobsen ..... 123/585
6,358,109 B1 * 3/2002 Neisen ..... 440/89 R
6,398,600 B1 * 6/2002 Lawson ..... 440/38

FOREIGN PATENT DOCUMENTS

JP 10-252440 A 9/1998
JP 2001-140641 A 5/2001

* cited by examiner

*Primary Examiner*—Hoang Nguyen
(74) *Attorney, Agent, or Firm*—Birch, Stewart, Kolasch & Birch, LLP

(57) ABSTRACT

To augment the durability of a turbocharger. A hull and a deck of a personal watercraft are formed watertight and an opening of the deck is closed with a seat to form a body internal space. An intake duct for introducing atmospheric air from outside the body is provided in the space. An engine and a turbocharger connected to an exhaust manifold of the engine are provided in the space and the turbocharger is disposed higher than a body internal opening of the intake duct. A water jacket is formed in a casing of a turbine portion of the turbocharger and an oil jacket is formed in a bearing casing of the turbocharger, and cooling water is supplied to the water jacket and cooling oil is supplied to the oil jacket. The cooling water to the water jacket is supplied by a different turbocharger cooling water passage independent of any other cooling water passage.

13 Claims, 14 Drawing Sheets

TURBOCHARGER ARRANGEMENT STRUCTURE FOR PERSONAL WATERCRAFT

CROSS-REFERENCE TO RELATED APPLICATIONS

The present application claims priority under 35 USC 119 to Japanese Patent Application No. 2001-219321 filed on Jul. 19, 2001 the entire contents thereof is hereby incorporated by reference.

BACKGROUND OF THE INVENTION

1. Field of the Invention

This invention relates to a turbocharger arrangement structure for a personal watercraft.

2. Description of Background Art

While the power source in widespread personal watercrafts conventionally is a 2-cycle engine, it has been considered to use a 4-cycle engine for the power source in order to cope with a reduction in pollution in recent years.

However, since the output power of the 4-cycle engine is lower than that of the 2-cycle engine of the same total stroke volume, it is examined to incorporate an engine with a turbocharger in order to make up the power. The assignee of the present invention has proposed a personal watercraft in which an engine with a turbocharger is incorporated as disclosed in Japanese Patent Laid-Open No. 2001-140641.

In this personal watercraft, a 4-cycle engine 2 with a turbocharger 3 is incorporated inside of a body 1 as shown in FIGS. 11 and 12.

As shown also in FIGS. 13 and 14, an exhaust manifold 4 is provided on the left side of the 4-cycle engine 2 in an advancing direction F of the body 1. An intake chamber 5 is provided on the right side of the 4-cycle engine 2.

Exhaust gas from an exhaust gas exit 4*a* of the exhaust manifold 4 is introduced into a turbine portion 3T of the turbocharger 3, and compressed air from a compressor portion 3C of the turbocharger 3 is supplied into the intake chamber 5 described above through an intercooler 6.

In such a personal watercraft as described above, in order to make it difficult for water to enter a body 1, it is necessary to form a hull 1*a* (refer to FIG. 11) and a deck 1*b* to be watertight and to close an opening in the deck with a lid member (for example, a seat 7) to form an internal body space 1*c*.

Meanwhile, in order to ensure intake of air into an engine 2, it is necessary to introduce atmospheric air from outside the body into the body internal space 1*c*. In a personal watercraft wherein a turbocharger is provided for an engine, when the atmospheric air outside the body is introduced into the body internal space 1*c* during operation of the personal watercraft, air is sometimes introduced together with water (for example, in the form of droplets) into the body. If the turbocharger is exposed to the water, then a casing and so forth of the turbocharger whose temperature is high is cooled suddenly and partially, which gives rise to disadvantages such as thermal fatigue that is liable to occur with the turbocharger.

SUMMARY AND OBJECTS OF THE INVENTION

The object of the present invention resides in a solution of such a problem as described above to provide a turbocharger arrangement structure for a personal watercraft which makes the turbocharger less liable to be exposed to water.

In order to attain the object described above, according to the present invention, a turbocharger arrangement structure for a personal watercraft includes a hull and a deck of the personal watercraft that are formed to be watertight and an opening of the deck that is closed up with a lid member to form a body internal space. An intake duct for introducing the atmospheric air outside the body is provided in the space while an engine and a turbocharger connected to an exhaust manifold of the engine are provided in the space and the turbocharger is disposed to be higher than a body internal opening of the intake duct.

According to the present invention, the turbocharger arrangement structure for a personal watercraft according to the present invention provides a water jacket that is formed in a casing of a turbine portion of the turbocharger and an oil jacket that is formed in a bearing casing of the turbocharger, and cooling water is supplied to the water jacket and cooling oil is supplied to the oil jacket.

According to the present invention, the turbocharger arrangement structure for a personal watercraft according to the present invention provides the cooling water to the water jacket that is supplied by a different turbocharger cooling water passage independent of any other cooling water passage.

With the turbocharger arrangement structure for a personal watercraft according to the present invention, the hull and the deck of the personal watercraft are formed to be watertight and the opening of the deck is closed up with the lid member to form the body internal space. The intake ducts for introducing the atmospheric air outside the body are provided in the space and the engine and the turbocharger are connected to the exhaust manifold of the engine and are provided in the space. The turbocharger is disposed to be higher than the body internal openings of the intake ducts. Therefore, when the atmospheric air outside the body is introduced into the body internal space through the intake ducts during operation of the personal watercraft, even if air is introduced together with water (for example, in the form of droplets), such a situation wherein the turbocharger becomes wet directly with the water becomes less likely to occur.

Accordingly, a situation wherein the casing and so forth of the turbocharger, whose temperature is high, are cooled suddenly and partially becomes less likely to occur. Thus thermal fatigue becomes less likely to occur with the turbocharger. As a result, the durability of the turbocharger is augmented.

The turbocharger arrangement structure for a personal watercraft according to the present invention provides a water jacket that is formed in the casing of the turbine portion of the turbocharge and the oil jacket is formed in the bearing casing for the turbocharger. Cooling water is supplied to the water jacket and cooling oil is supplied to the oil jacket. Consequently, such a situation wherein the temperature of the turbocharger becomes excessively high is eliminated.

Accordingly, when the atmospheric air outside the body is introduced into the body internal space through the intake ducts during operation of the personal watercraft, even if air is introduced together with water (for example, in the form of droplets) and the turbocharger becomes exposed to the water, the temperature variation of the casing of the turbocharger by the water is suppressed to be small.

As a result, thermal fatigue becomes less likely to occur with the turbocharger, and the durability of the turbocharger is augmented with certainty.

With the turbocharger arrangement structure for a personal watercraft according to the present invention, cooling water for the water jacket is supplied through the different turbocharger cooling water passages independent of the other cooling water passages. Thus, the turbocharger is cooled efficiently.

Accordingly, when the atmospheric air outside the body is introduced into the body internal space through the intake ducts during operation of the personal watercraft, even if air is introduced together with water (for example, in the form of droplets) and the turbocharger is exposed to the water, the temperature variation of the casing of the turbocharger by the water is suppressed smaller.

As a result, thermal fatigue becomes further less likely to occur with the turbocharger, and the durability of the turbocharger is augmented with a higher degree of certainty.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by illustration only, and thus are not limitative of the present invention, and wherein.

DETAILED DESCRIPTION OF THE PREFERRED EMBODIMENTS

In the following, an embodiment of the present invention is described with reference to the drawings.

Figure 1:
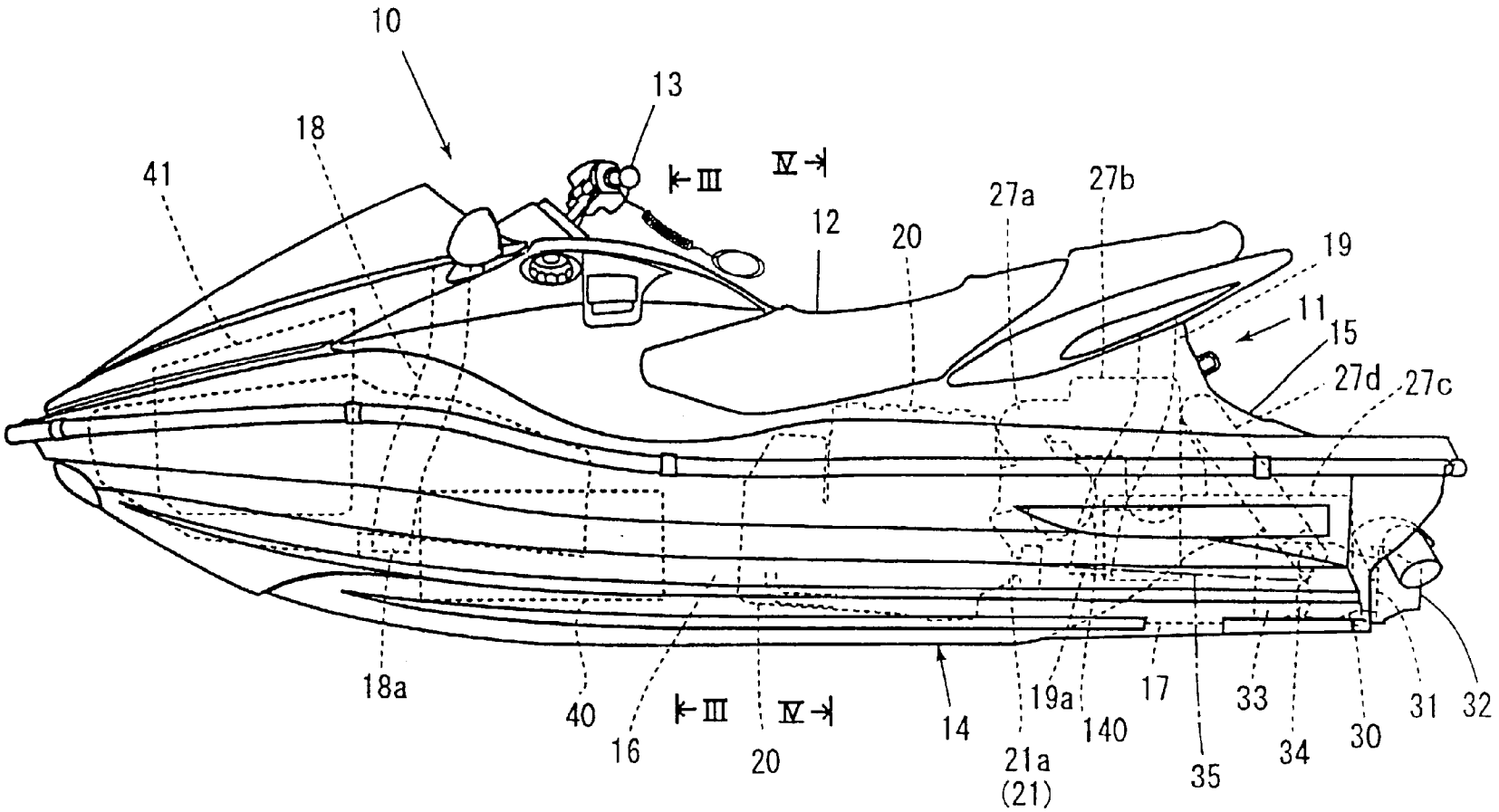
FIG. 1 is a schematic side elevational view showing an example of a watercraft which uses an embodiment of the turbocharger arrangement for a personal watercraft according to the present invention.

As shown in FIG. 1, a personal watercraft 10 is a personal watercraft of the type, wherein a driver can sit on a seat 12 on a body 11 and grip a steering 13 with a throttle lever to steer the personal watercraft 10.

The body 11 has a floating body structure wherein a hull 14 and a deck 15 are joined together such that a space 16 is formed inside thereof. An opening 15*a* (refer to FIG. 4) of the deck 15 is closed up with the seat 12 serving as a lid member removably mounted on the deck 15. In the space 16, an engine 20 is mounted on the hull 14, and a jet pump (jet propulsion pump) 30 as propulsion means which is driven by the engine 20 is provided at a rear portion of the hull 14.

The jet pump 30 has a passage 33 extending from an intake 17 open to the bottom to a jet outlet 31 and a nozzle 32 open to the rear end of the body and an impeller 34 disposed in the passage 33. A shaft 35 of the impeller 34 is connected to an output power shaft 21*a* of the engine 20. Accordingly, if the impeller 34 is driven to rotate by the engine 20, then water taken in from the intake 17 is jetted from the nozzle 32 through the jet outlet 31 so that the body 11 is propelled. The driving speed of the engine 20, that is, the propelling force by the jet pump 30, is operated by a pivoting operation of a throttle lever 13*a* (refer to FIG. 2) of the steering handle 13 described above. The nozzle 32 is operatively associated with the steering handle 13 by an operation wire not shown such that it is pivoted by an operation of the steering handle 13, and the advancing direction can be changed thereby.

A fuel tank 40 and an accommodation chamber 41 are operatively connected to the body 11.

Figure 4:
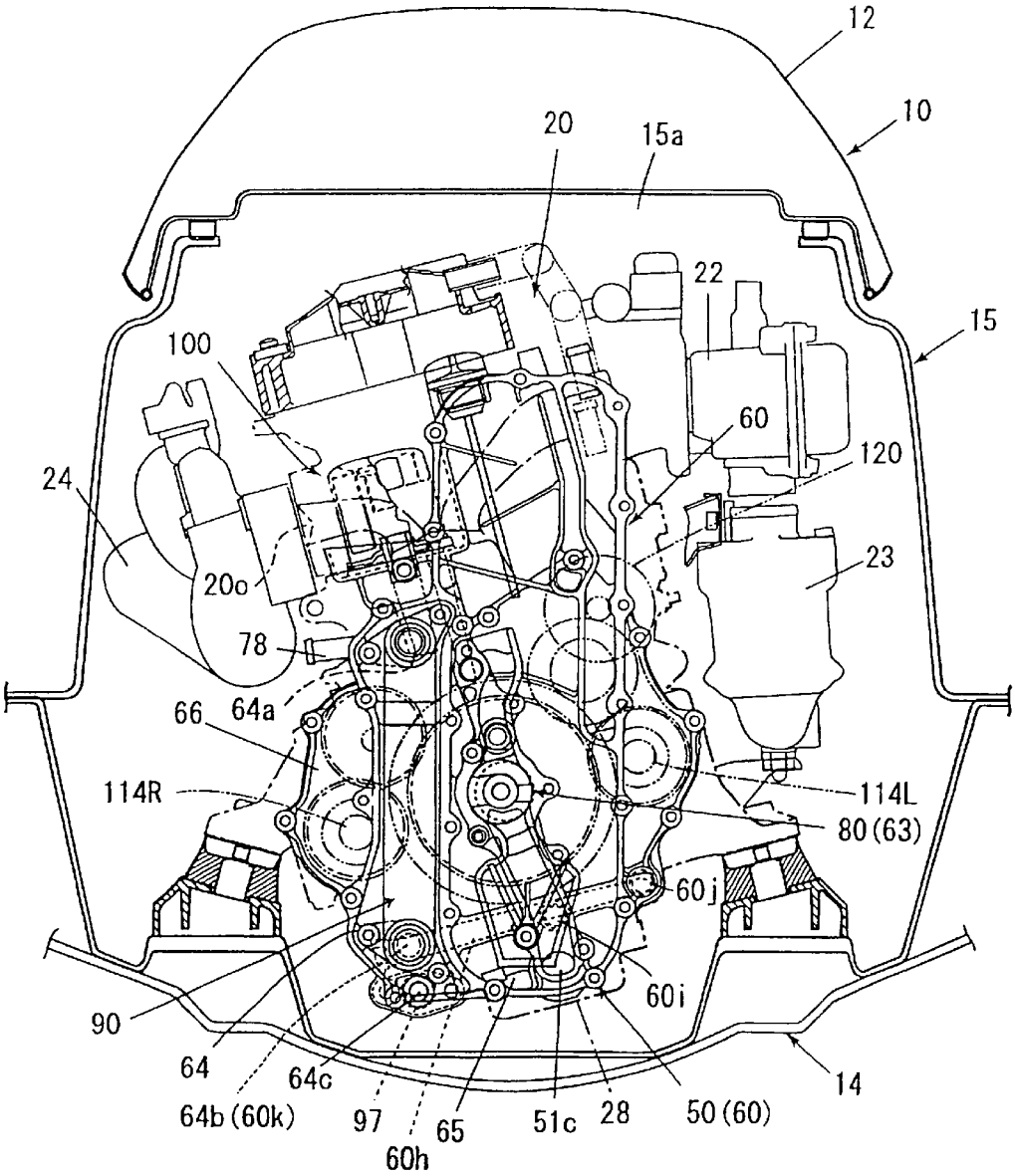
FIG. 4 is a view principally showing an engine 20 and is a partial enlarged sectional view (partly omitted sectional view) taken along line IV—IV of FIG. 1.

As illustrated in FIG. 4, the engine 20 is a DOHC in-line four-cylinder dry sump type 4-cycle engine and is disposed such that the crankshaft 21*a* thereof extends in the forward and backward direction of the body 11 as shown in FIG. 1.

Figure 7:
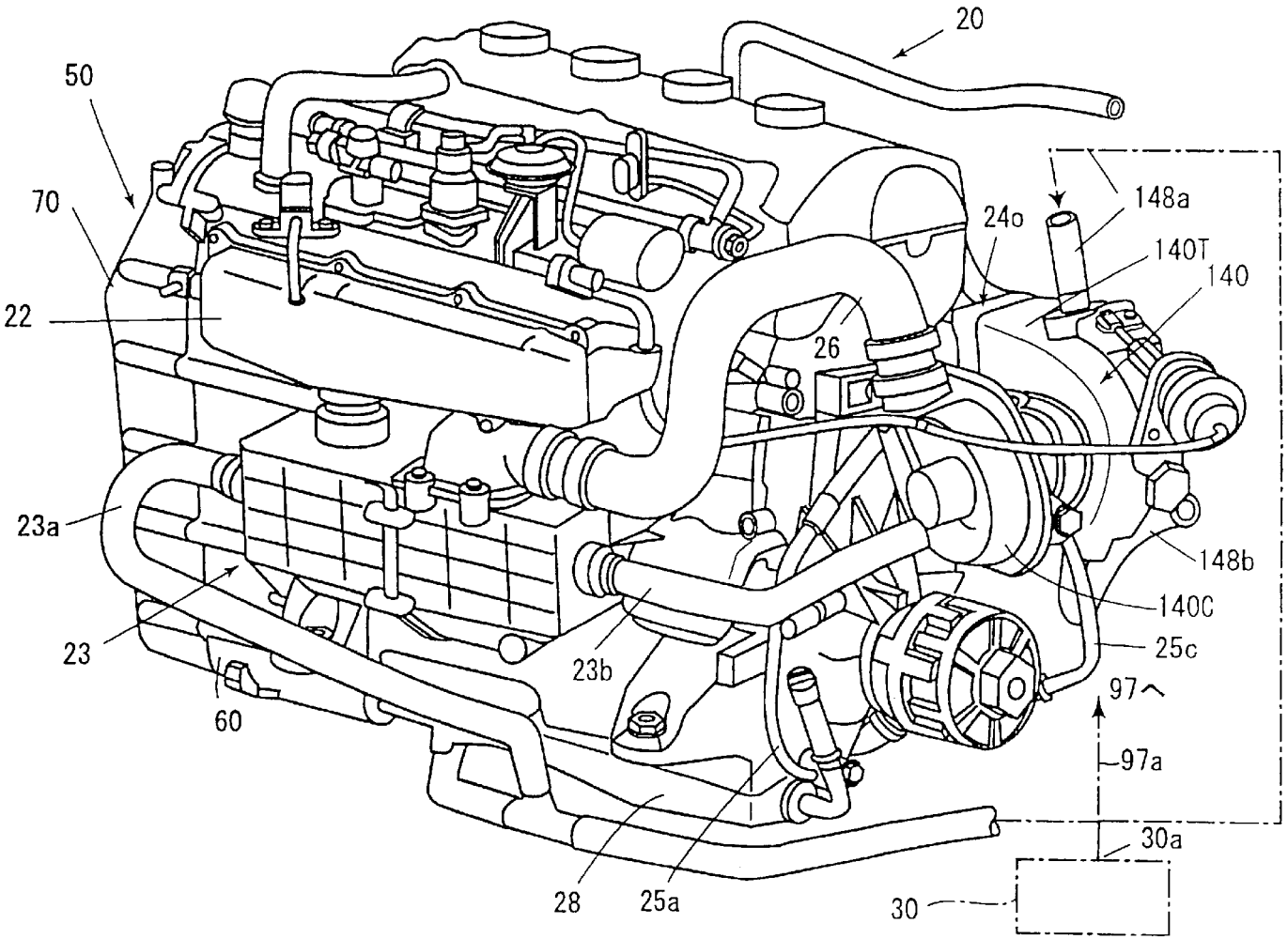
FIG. 7 is a schematic perspective view of the engine 20 as viewed from obliquely rearwardly.

As shown in FIGS. 4 and 7, a surge tank (intake chamber) 22 and an intercooler 23 communicated with an intake port are connected and disposed on the left side of the engine 20 with respect to the advancing direction of the body 11, and an exhaust manifold 24 is in communication with an exhaust port 200 and is connected and disposed on the right side of the engine 20.

Figure 6:
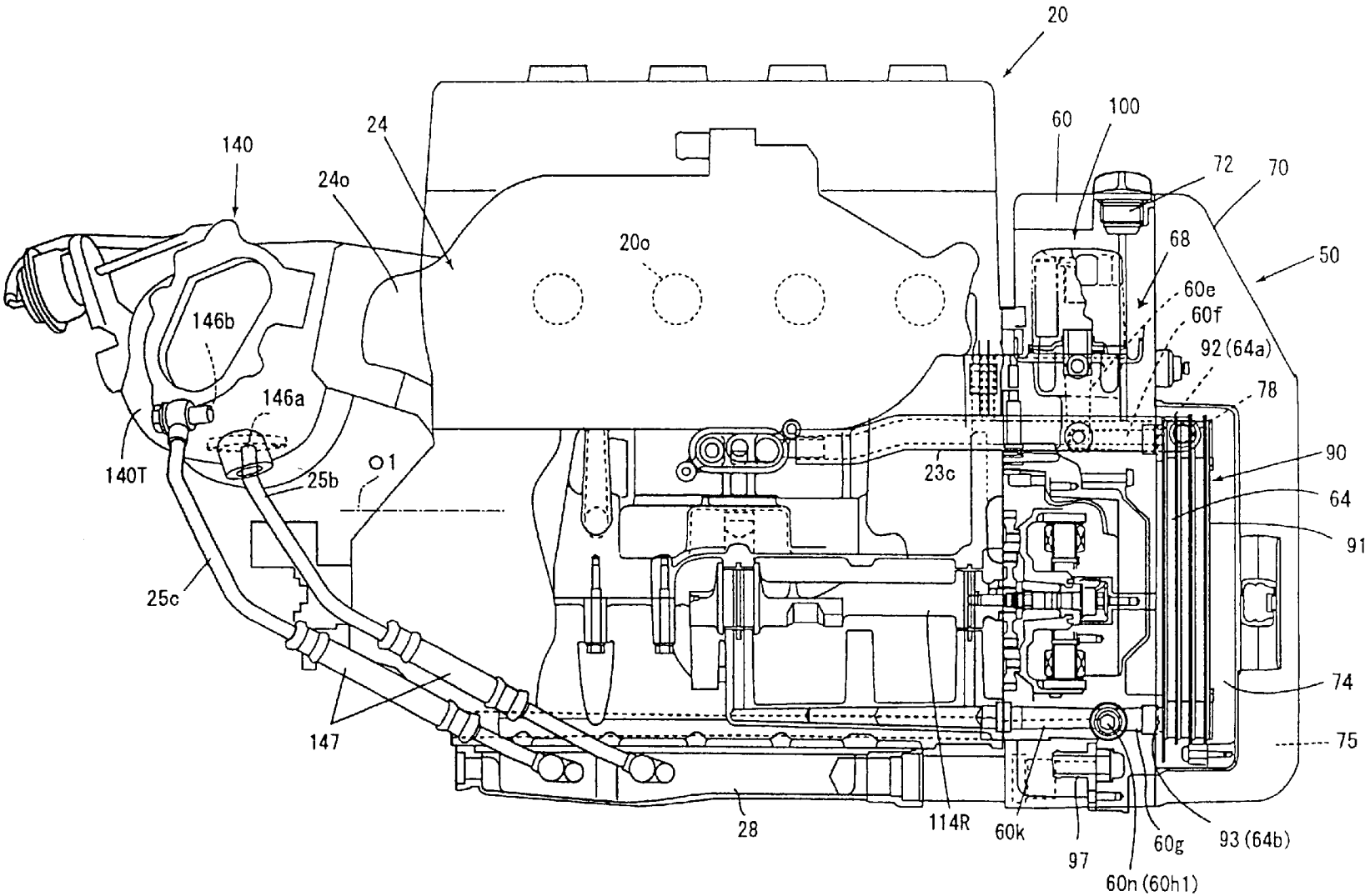
FIG. 6 is a left side elevational view of the engine 20.

As shown in FIGS. 6 and 7, a turbocharger (turbocharger) 140 is disposed rearwardly of the engine 20, and an exhaust gas exit 24*o* of the exhaust manifold 24 is connected to a turbine portion 140T of the turbocharger 140 while the intercooler 23 is connected to a compressor portion 140C of the turbocharger 140 by a pipe 26 (refer to FIG. 7). In FIG. 7, a cooling water hoses 23*a*, 23*b* are connected to the intercooler 23.

Figure 2:
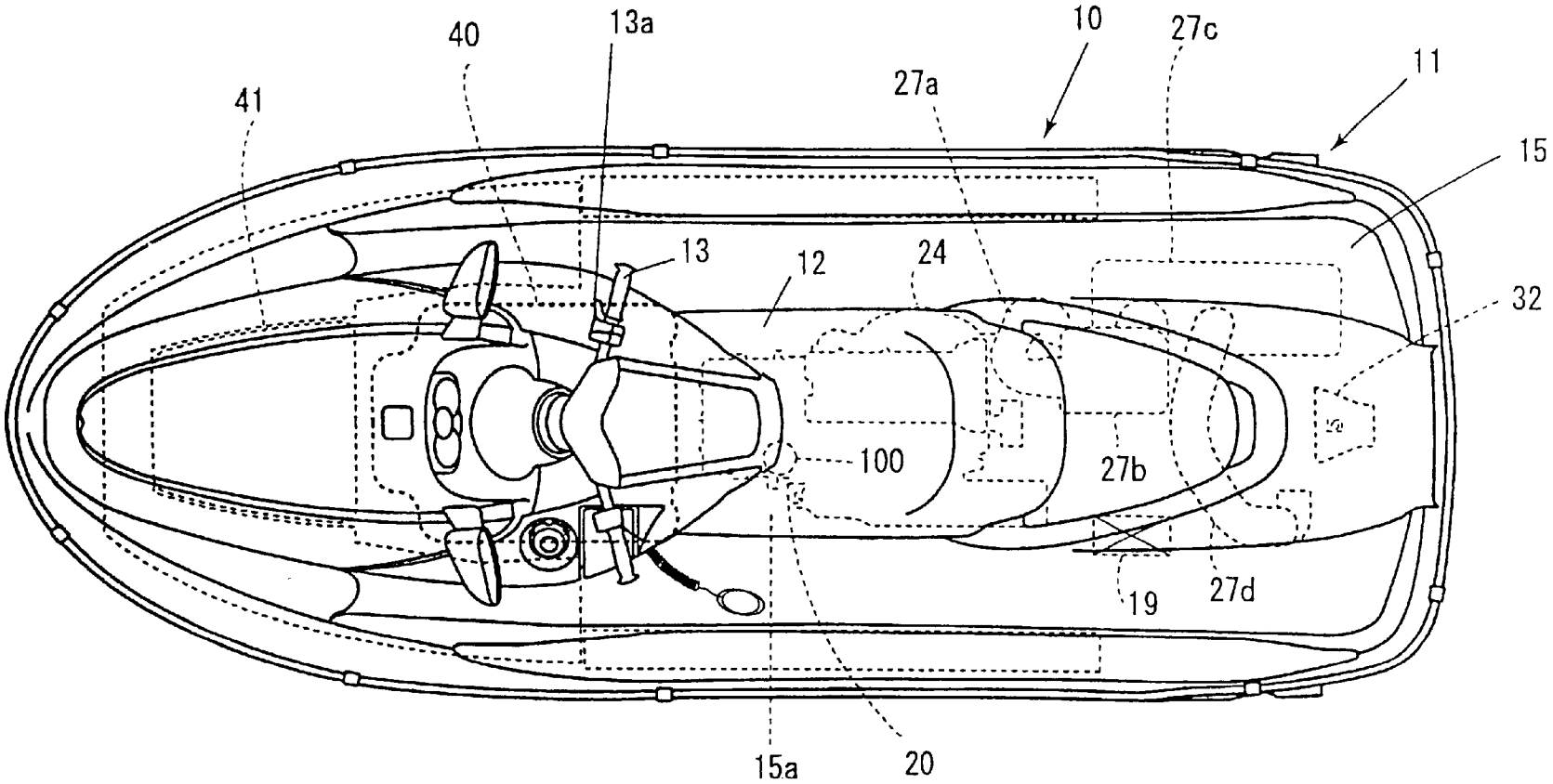
FIG. 2 is a plan view of the personal watercraft in FIG. 1.
Figure 3:
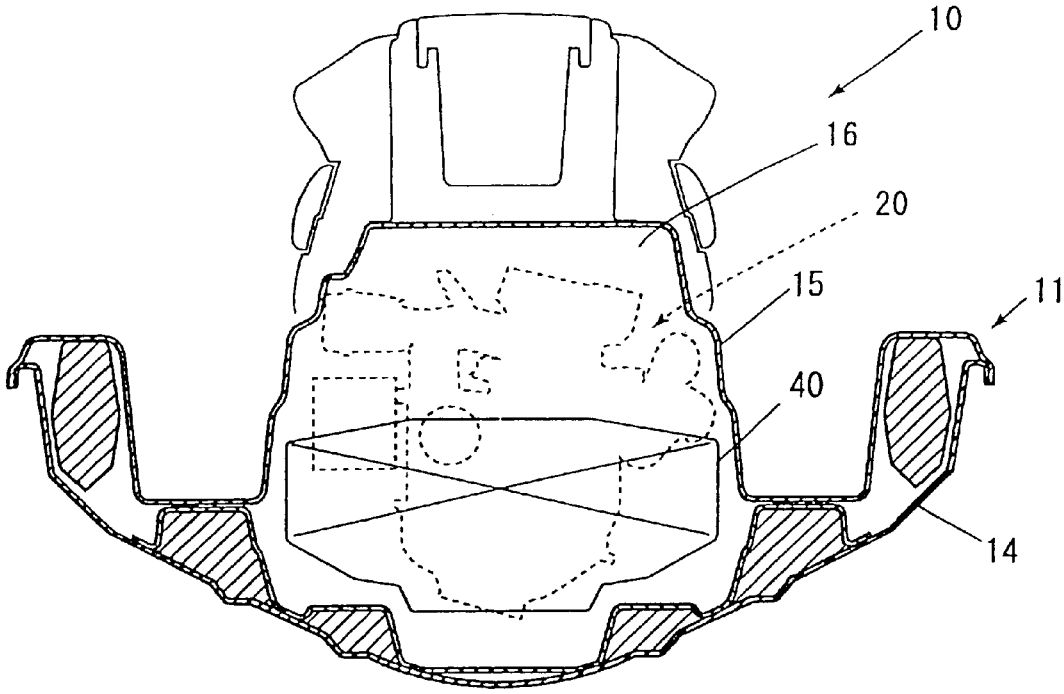
FIG. 3 is a partial enlarged sectional view (partly omitted sectional view) taken along line III—III of FIG. 1.

It is to be noted that exhaust gas which has rotated a turbine in the turbine portion 140T of the turbocharger 140 passes, as shown in FIGS. 1 and 2, through an exhaust pipe 27*a*, a backflow preventing chamber 27*b* for preventing a backflow of water (admission of water into the turbocharger 140 and so forth). Upon capsize, a water muffler 27*c* and an drain pipe 27*d* and is exhausted into a water stream produced by the jet pump 30.

Referring to FIG. 1, intake ducts 18, 19 are provided for introducing the atmospheric air outside the body 11 into the space 16 in the body 11. Lower ends 18*a*, 19*a* of the intake ducts 18, 19 are provided to be lower than the turbocharger 140 described above in the body 11. In other words, the turbocharger 140 is provided to be higher than the openings 18*a*, 19*a* of the intake ducts 18, 19 in the body. The turbocharger 140 is provided substantially in the center in the vertical direction in the space 16 of the body.

Figure 5:
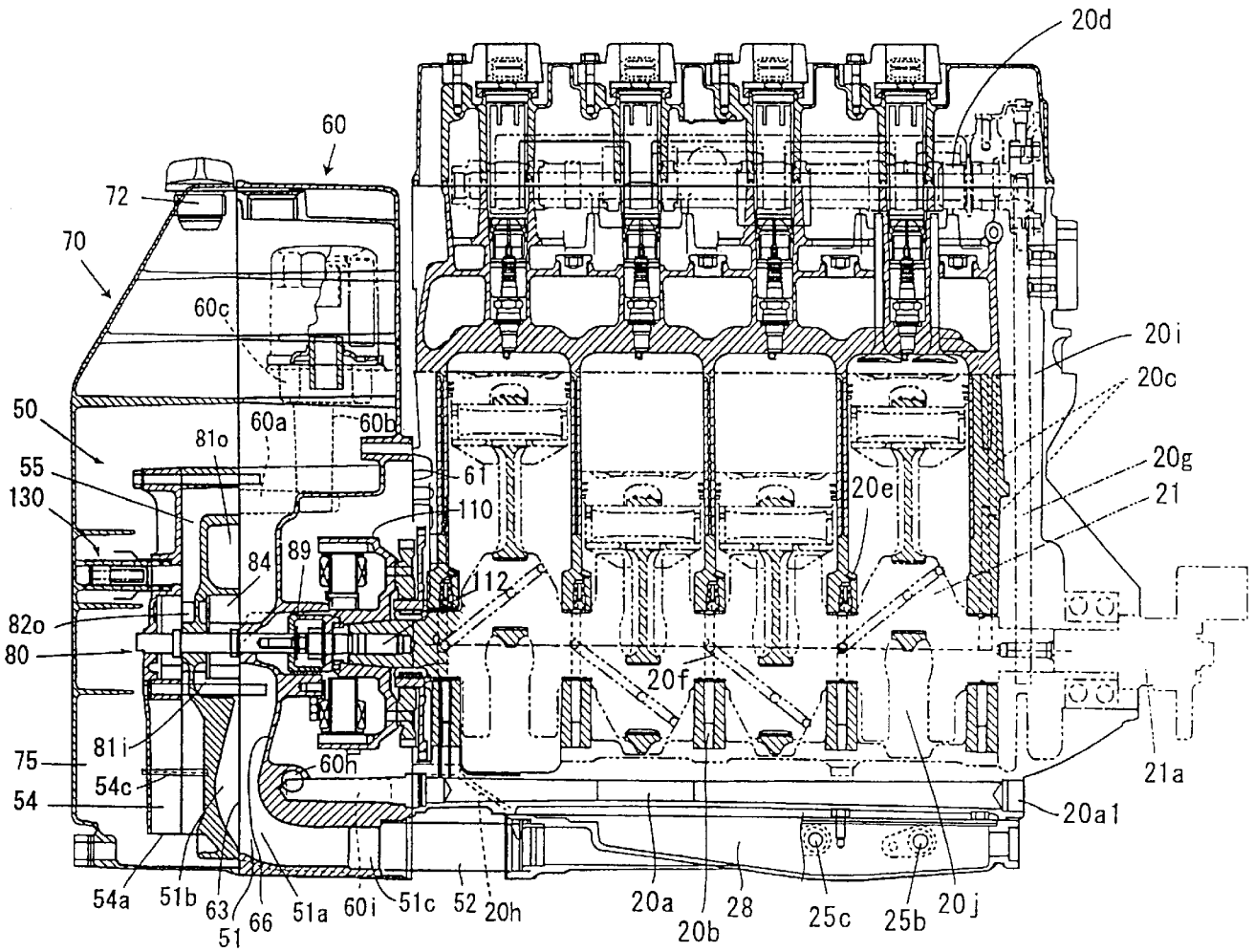
FIG. 5 is a right side elevational view of the engine 20.

As shown in FIGS. 4 to 7, an oil tank 50 and an oil pump 80 are provided integrally on an extension line of a crankshaft 21 at a front portion of the engine 20 (in the advancing direction of the body 11, and at a left portion in FIGS. 1 and 5). The oil pump 80 is provided in the oil tank 50.

The oil tank 50 is formed from a tank body (one divided case) 60 joined to a front face of the engine 20 and a cover (the other divided case) 70 joined to a front face of the tank body 60.

As shown in FIGS. 4 and 6, a water cooling type oil cooler 90 is provided on the front face of the tank body 60 in the oil tank 50, and an oil filter 100 is provided at an upper portion of the oil tank 50.

Figure 8:
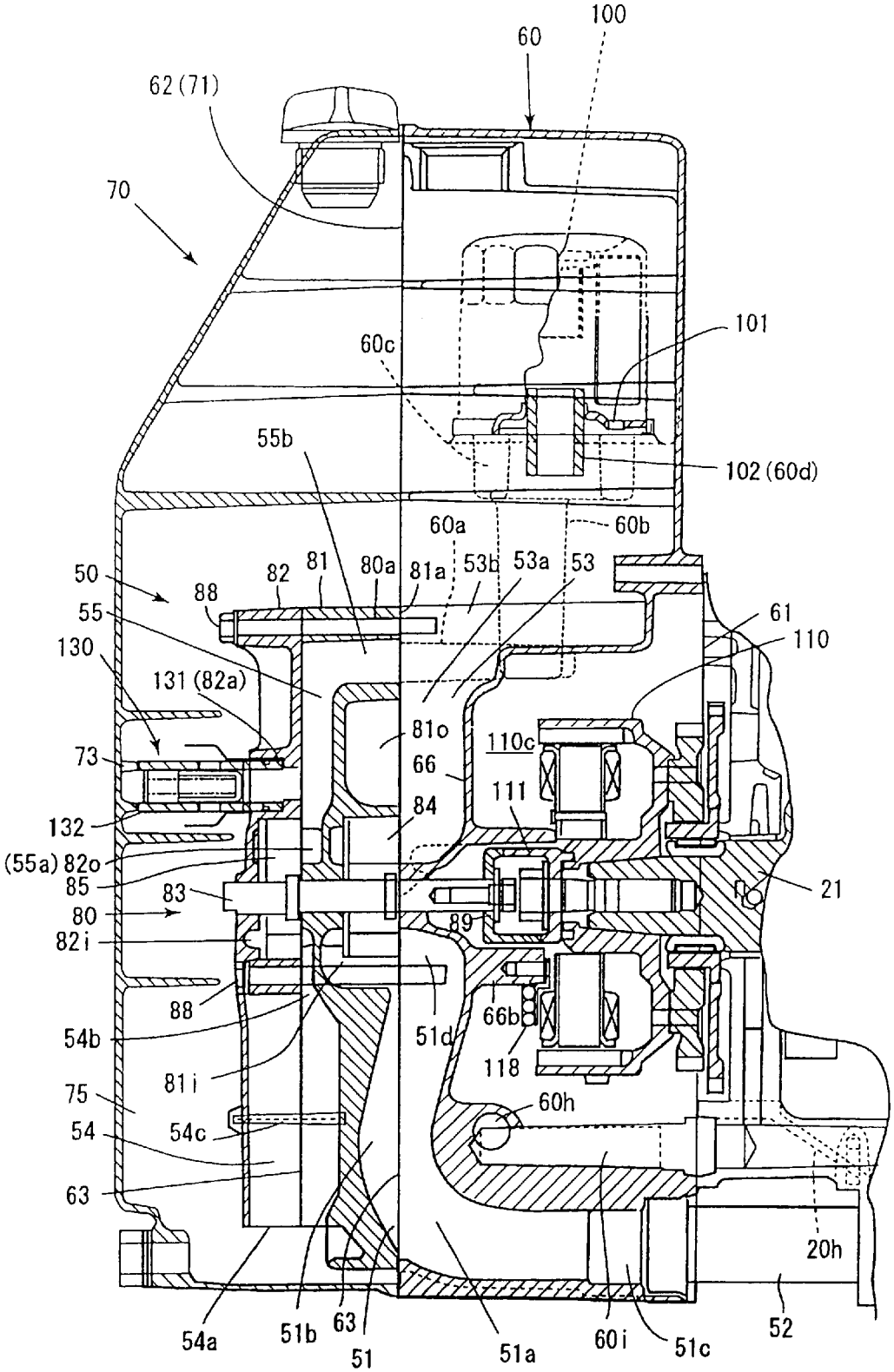
FIG. 8 is a partial enlarged view of FIG. 5.

As shown in FIGS. 4, 5 and 8, the tank body 60 has a joining face 61 to the front face of the engine 20, a joining face 62 to the cover 70, a mounting portion 63 for the oil pump 80, a mounting portion 64 for the water cooling type oil cooler 90, a generally vertically elongated oil accommodation portion 65 defined by partition walls and outer walls which form the mounting surfaces of them, an ACG 110, balancer shafts 114L, 114R, and a cover portion 66 for a drive chamber of a starter motor 120. Further, as shown in FIG. 6, the tank body 60 has a mounting portion 68 for the oil filter 100.

The tank body 60 is joined at the joining face 61 thereof described above to the front face of the engine 20 and integrally secured to the front face of the engine 20 by bolts not shown in such a manner that it covers the elements described above. It is to be noted that the tank body 60 is attached to the front face of the engine 20 after the oil pump 80 and the type oil cooler 90 are attached thereto.

The cover 70 has a joining face 71 to the tank body 60, a refilling opening 72 for oil, a holding portion 73 for a relief valve 130, an accommodation portion 74 (refer to FIG. 6) for the oil cooler 90, and an oil accommodation portion 75 defined by outer walls and a partition wall.

The oil pump 80 includes a first case 81 joined to the tank body 60 described above, a second case 82 joined to the first case 81, a pump shaft 83 provided such that it extends through the first and second cases, inner and outer rotors 84 coupled to the pump shaft 83 in the first case 81 described above for recovering oil, and inner and outer rotors 85 coupled to the pump shaft 83 in the second case 82 described above for supplying oil.

The inner and outer rotors 84 for recovering oil cooperates with the first case 81 to form an oil recovery pump, and the inner and outer rotors 85 for supplying oil cooperates with the first and second cases 81, 82 to form an oil supply pump.

The oil pump 80 is attached to the front face of the tank body 60 by means of bolts 88 after the joining face of the first case 81 to the tank body 60 is jointed to the mounting portion 63 on the front face of the tank body 60 formed in the same shape as that of the joining face.

After the oil pump 80 is attached to the tank body 60 in this manner, a coupling 89 is secured to the rear end of the pump shaft 83 from the rear face side of the tank body 60 by means of bolts.

Accordingly, the tank body 60 is attached to the front face of the engine 20 such that the coupling 89 is coupled to a coupling 111 provided at an end of an ACG shaft after the oil pump 80 and the coupling 89 are attached and further the oil cooler 90 is attached.

The water cooling type oil cooler 90 is attached to the front face side of the mounting portion 64 of the tank body 60 for the oil cooler 90.

As shown in FIGS. 4 and 6, an upper hole 64*a* and a lower hole 64*b* which are in communication with an oil passage which is hereinafter described are formed in the mounting portion 64 of the tank body 60.

The oil cooler 90 has a plurality of heat exchanging plates 91 through the inside of which oil passes, an entrance pipe 92 for oil in communication with an upper portion thereof with the inside of the plates 91. An exit pipe 93 is provided for oil in communication with a lower portion thereof with the inside of the plates 91.

Accordingly, the oil cooler 90 is attached to the mounting portion 64 of the tank body 60 such that the entrance pipe 92 thereof is connected to the upper hole 64*a* of the tank body 60 and the exit pipe 93 thereof is connected to the lower hole 64*b* of the tank body 60.

As shown in FIGS. 4 and 6, a cooling water introduction pipe 97 is in communication with a hole 64*c* open to the mounting portion 64 and introduces cooling water into the accommodation portion 74 of the oil cooler in the mounting portion 64 and the cover 70 is provided on the tank body 60. A discharge pipe 78 is provided for water in the cover 70. A cooling water hole 97*a* from a cooling water output port 30*a* (refer to FIG. 7) of the jet pump 30 is connected directly to the introduction pipe 97 without intervention of any other cooling device. An drain pipe 23*c* is connected to the discharge pipe 78 as shown in FIG. 6. Water from the discharge pipe 78 is supplied into the water jacket of the exhaust manifold 24 through the drain pipe 23*c*.

The cover 70 is joined to the front face of the tank body 60 and secured by means of bolts not shown such that a front end 132 of the relief valve 130 is held down by the holding portion 73 described hereinabove after the tank body 60, oil pump 80 and oil cooler 90 are attached to the front face of the engine 20 in such a manner as described above. Thereafter, a rear end 131 of the relief valve 130 is fitted into a hole 82*a* formed in the front face of the second case 82 of the oil pump 80 as shown in FIGS. 5 and 8. The relief valve 130 is disposed horizontally in this manner.

In the state wherein the tank body 60 and the cover 70 are joined together, a single oil accommodation section is formed from the oil accommodation portions 65, 75.

Further, the oil filter 100 is attached to the mounting portion 68 of the tank body 60 for the oil filter 100.

It is to be noted that, in a state wherein the engine 20 is incorporated in the body 11, the engine 20 and the oil filter 100 are opposed to the opening 15*a* of the deck 15 as shown in FIGS. 2 and 4. The opening 15*a* of the deck 15 is opened by removing the seat 12, which is removably mounted on the body 11.

Such oil passages as described below are formed in a state wherein the oil tank 50 (that is, the tank body 60, the cover 70, and the oil pump 80, oil cooler 90, and relief valve 130 built in them) is mounted on the front face of the engine 20 and the oil filter 100 is mounted therein.

As shown in FIGS. 5 and 8, an oil recovery passage 51 is formed by the front face of the tank body 60 and the rear face of the first case 81 of the oil pump 80. The recovery passage 51 is formed from an oil passage 51*a* formed on the tank body 60 side and an oil passage 51*b* formed on the first case 81 side of the oil pump 80 in an opposing relationship to the oil passage 51*a*.

A lower end 51*c* of the oil recovery passage 51 is in communication with an oil pan 28 of the engine 20 through a pipe 52. An upper end 51*d* of the oil recovery passage 51 is in communication with a recovered oil inlet port 81*i* formed in the first case 81 of the oil pump 80.

Similarly, a discharge passage 53 for recovered oil is formed by the front face of the tank body 60 and the rear face of the first case 81 of the oil pump 80. The discharge passage 53 is formed from an oil passage 53*a* formed on the tank body 60 side and a recovered oil discharge port 81*o* formed on the first case 81 side of the oil pump 80 in an opposing relationship to the oil passage 53*a*.

An upper end 53*b* of the discharge path 53 is open to the inside of the oil tank 50 (that is, to the inside of the oil accommodation section).

Meanwhile, an intake passage 54 and a discharge passage 55 for supply oil are formed by the front face of the first case 81 and the rear face of the second case 82 of the oil pump 80.

A lower end 54*a* of the intake passage 54 is open to the inside of the oil tank 50 (that is, to the inside of the oil accommodation section), and an upper end 54*b* of the intake passage 54 is in communication with a supply oil inlet port 82*i* of the oil supply pump. A screen oil filter 54*c* is provided in the intake passage 54.

A lower end 55*a* of the discharge passage 55 is in communication with a supply oil discharge port 82*o* of the oil supply pump, and an upper end 55*b* of the discharge passage 55 extends horizontally through an upper portion of the first case 81 and is in communication with a horizontal hole 60*a* formed in the tank body 60. The horizontal hole 60*a* is communicated with a vertical hole 60*b* similarly formed in the tank body 60. An upper end 60*c* of the vertical hole 60*b* is open in the form of a ring as viewed in plan to the mounting portion 68 of the oil filter 100. An oil inlet passage 101 of the oil filter 100 is in communication with the opening 60*c*.

The mounting hole 82*a* for the relief valve 130 described hereinabove is open to the discharge passage 55, and the relief valve 130 is attached in such a manner as described above to the mounting hole 82*a*.

A male thread is provided on an oil exit pipe 102 in the oil filter 100. The oil filter 100 is attached to the mounting portion 68 of the tank body 60 by screwing the oil exit pipe 102 into a female threaded hole 60*d* formed in the mounting portion 68 of the tank body 60.

As shown in FIG. 6, a vertical hole 60*e* and a horizontal hole 60*f* are in communication with a lower end of the vertical hole 60*e* and are formed at a lower portion of the female threaded hole 60*d* in the tank body 60. The horizontal hole 60*f* is in communication with the entrance pipe 92 of the oil cooler 90 through the upper hole 64*a* of the mounting portion 64 of the oil cooler 90 described hereinabove.

Meanwhile, an oil passage 60*g* communicating with the lower hole 64*b* and an oil distributing passage 60*h* communicating with the passage 60*g* are formed in the lower hole 64*b* of the tank body 60 described hereinabove to which the exit pipe 93 of the oil cooler 90 is connected. Further, a main gallery supply passage 60*i* for supplying oil to a main gallery 20*a* (refer to FIG. 5) of the engine 20, a left balancer supply passage 60*j* for supplying oil to bearing portions of the left balancer 114L described hereinabove and a right balancer supply passage 60*k* for supplying oil to bearing portions of the right balancer 114R are in communication with the oil distributing passage 60*h*.

It is to be noted that one end of the oil distributing passage 60*h* is closed up with a plug 60*n* (refer to FIG. 6).

Figure 9:
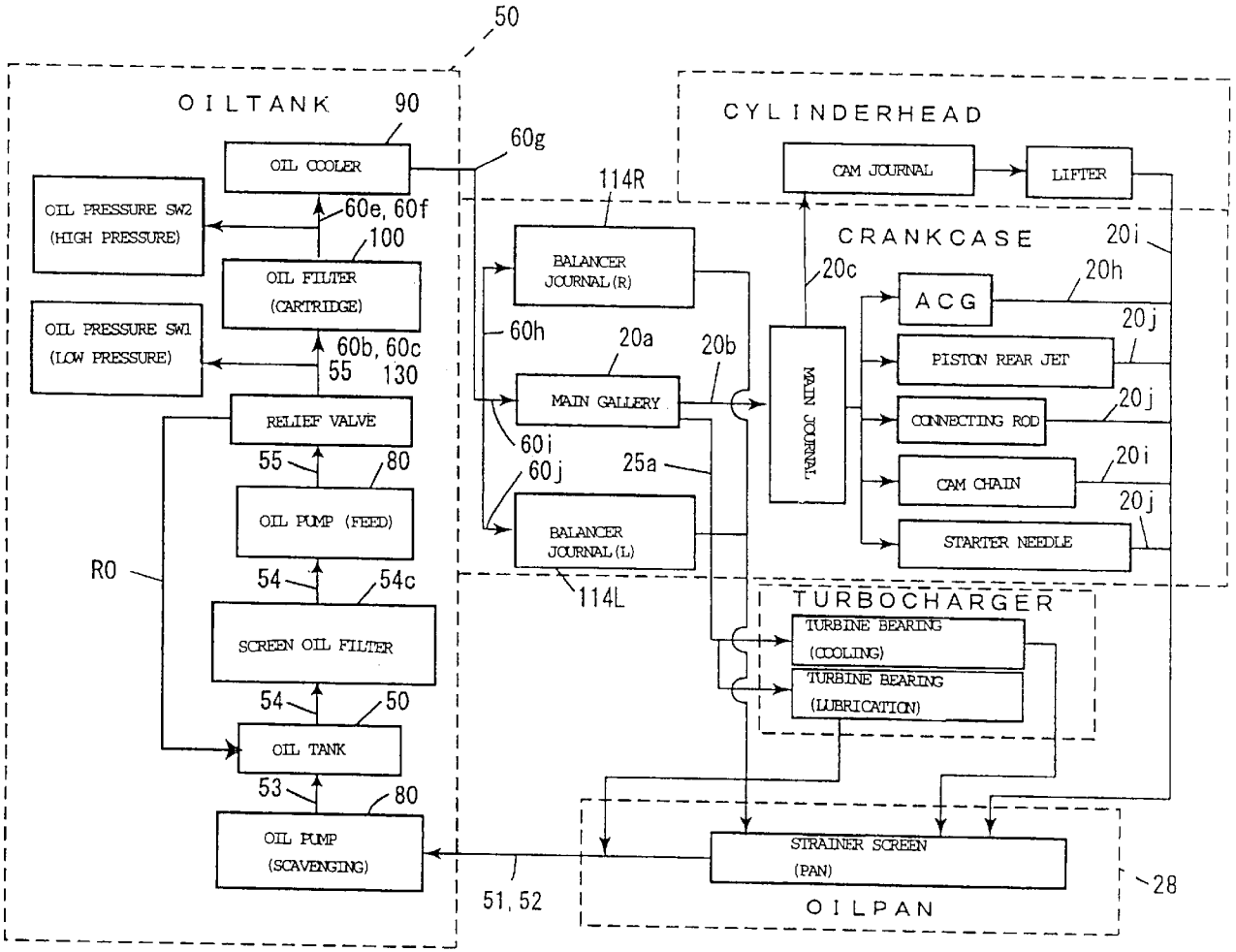
FIG. 9 is a view of a circulation route of oil.

The route of oil supplied to the main gallery 20*a* of the engine 20 is such as shown in FIG. 9 (oil circulation route diagram).

The route from the main gallery 20*a* is generally divided into two.

The first route is a route along which oil is supplied to bearing portions of the crankshaft 21 through a route 20*b* (refer to FIG. 5), and the second route is a route along which oil is supplied from a rear end 20*a*1 of the main gallery 20*a* through a pipe 25*a* (refer to FIG. 7) to cool and lubricate turbine bearings of the turbocharger 140. The oil which has cooled and lubricated the turbine bearings of the turbocharger 140 is recovered into the oil pan 28 through pipes 25*b*, 25*c* (refer to FIG. 6).

The oil supplied to the bearing portions of the crankshaft 21 further lubricates cam journal 20*d* portions and lifter portions of a cylinder head through a route 20*c* and then returns to the oil pan 28 through a chain chamber 20*i*.

Meanwhile, the oil supplied to the bearing portions of the crankshaft 21 is further supplied to the ACG, piston rear jet nozzles, connecting rod, cam chain and starter needle and is recovered into the oil pan 28 through respective recovery passages. In FIG. 5, a jet nozzle 20*e* is provided for jetting oil to the rear side of the piston to cool the piston. A passage 20*f* is provided to the connecting rod portion. A cam chain 20*g* is operatively connected to the engine. Further, a return passage 20*h* provides a returning passage for oil from an ACG chamber 110*c*.

The oil in the ACG chamber returns to the oil pan 28 through a return passage 20*h* therefor, and the oil jetted to the rears of the pistons from jet nozzles 20*e*, the oil supplied to the connecting rod and the oil supplied to the starter needle return to the oil pan 28 individually through a crank chamber 20*j*.

As is apparent from the foregoing description, a general flow of oil is described below with reference principally to FIG. 9.

Oil flows from the oil tank 50 to the intake passage 54 to the screen oil filter 54*c* to the oil pump (supply pump) 80 to the discharge passage 55 (and relief valve 130, horizontal hole 60*a*, vertical hole 60*b*, ring-form opening 60*c*) to the oil filter 100 to the vertical hole 60*e*, horizontal hole 60*f* to the oil cooler 90 to the oil passage 60*g*, oil distributing passage 60*h* to the main gallery supply passage 60*i*, left balancer supply passage 60*j*, right balancer supply passage 60*k* and to the main gallery 20*a*, left balancer 114L, right balancer 114R.

Relief oil RO from the relief valve 130 returns directly into the oil tank 50.

Oil supplied to the left balancer 114L, right balancer 114R returns to the oil pan 28 through the crank chamber 20*j*.

Meanwhile, oil supplied to the various portions described above from the main gallery 20*a* returns to the oil pan 28 in such a manner as described above.

Then, the oil returned to the oil pan 28 is recovered into the oil tank 50 through the pipe 52, recovery passage 51, oil pump 80 (recovery pump) and recovered oil discharge path 53, and is circulated by the route described above from the intake passage 54.

Figure 10:
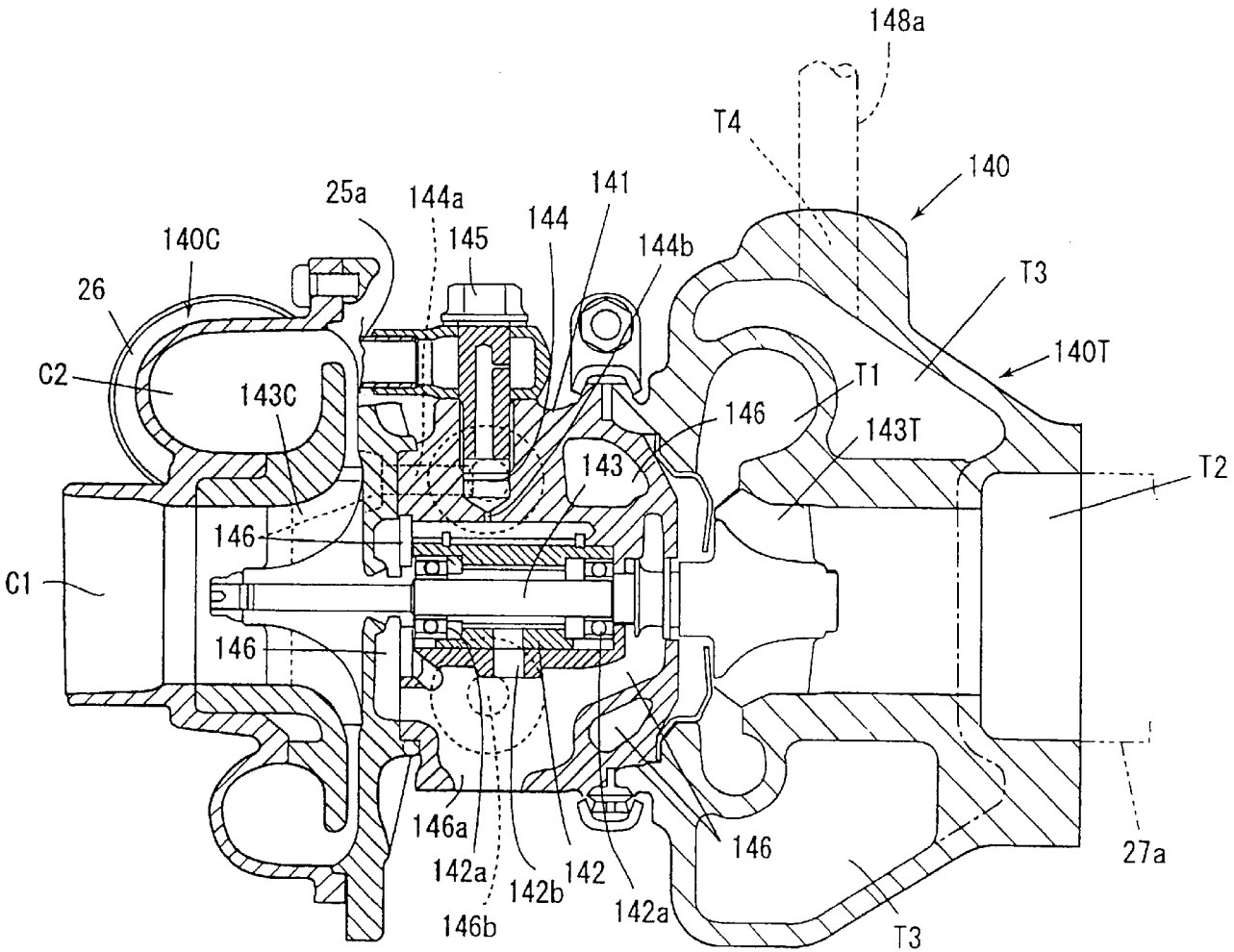
FIG. 10 is a sectional view of a turbocharger 140.
Figure 11:
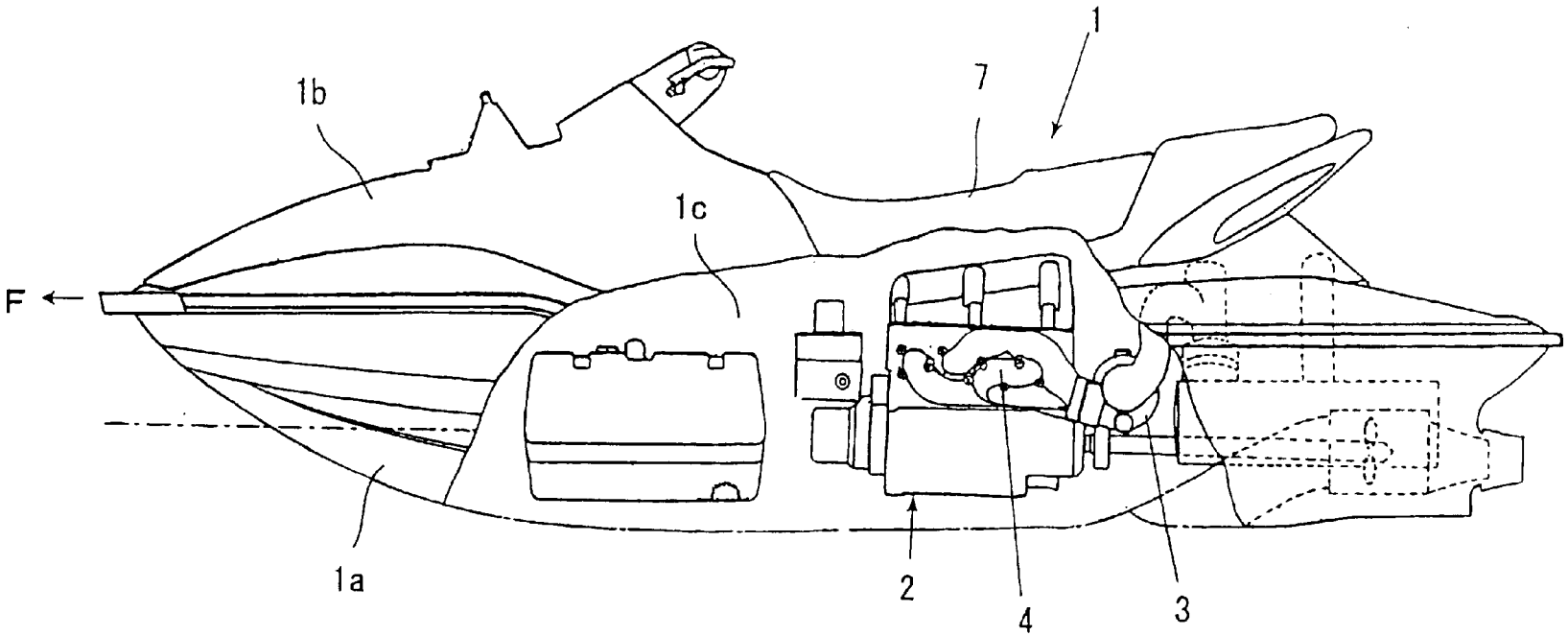
FIG. 11 PRIOR ART
FIG. 11 is an explanatory view of the prior art.
Figure 12:
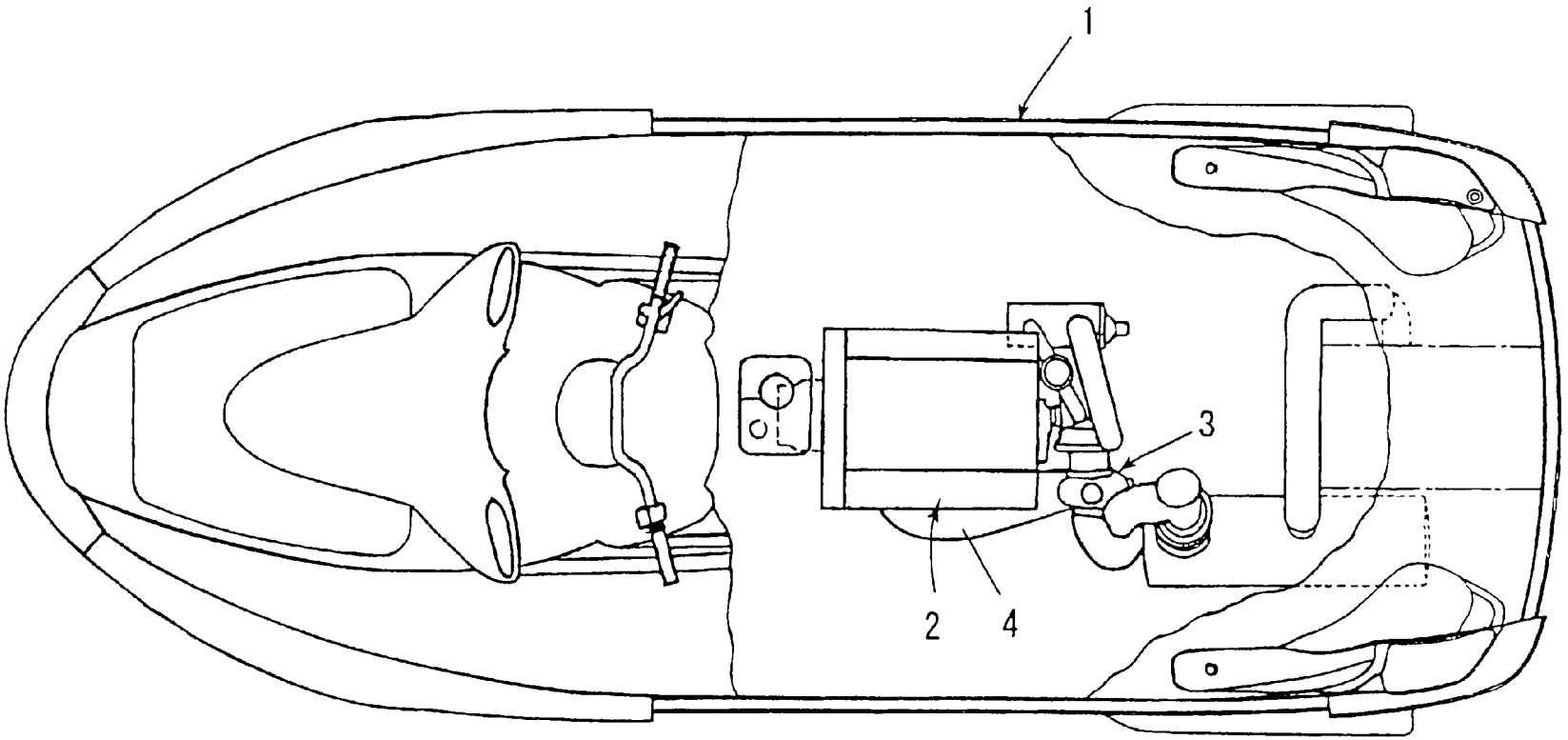
FIG. 12 PRIOR ART
FIG. 12 is an explanatory view of the prior art.
Figure 13:
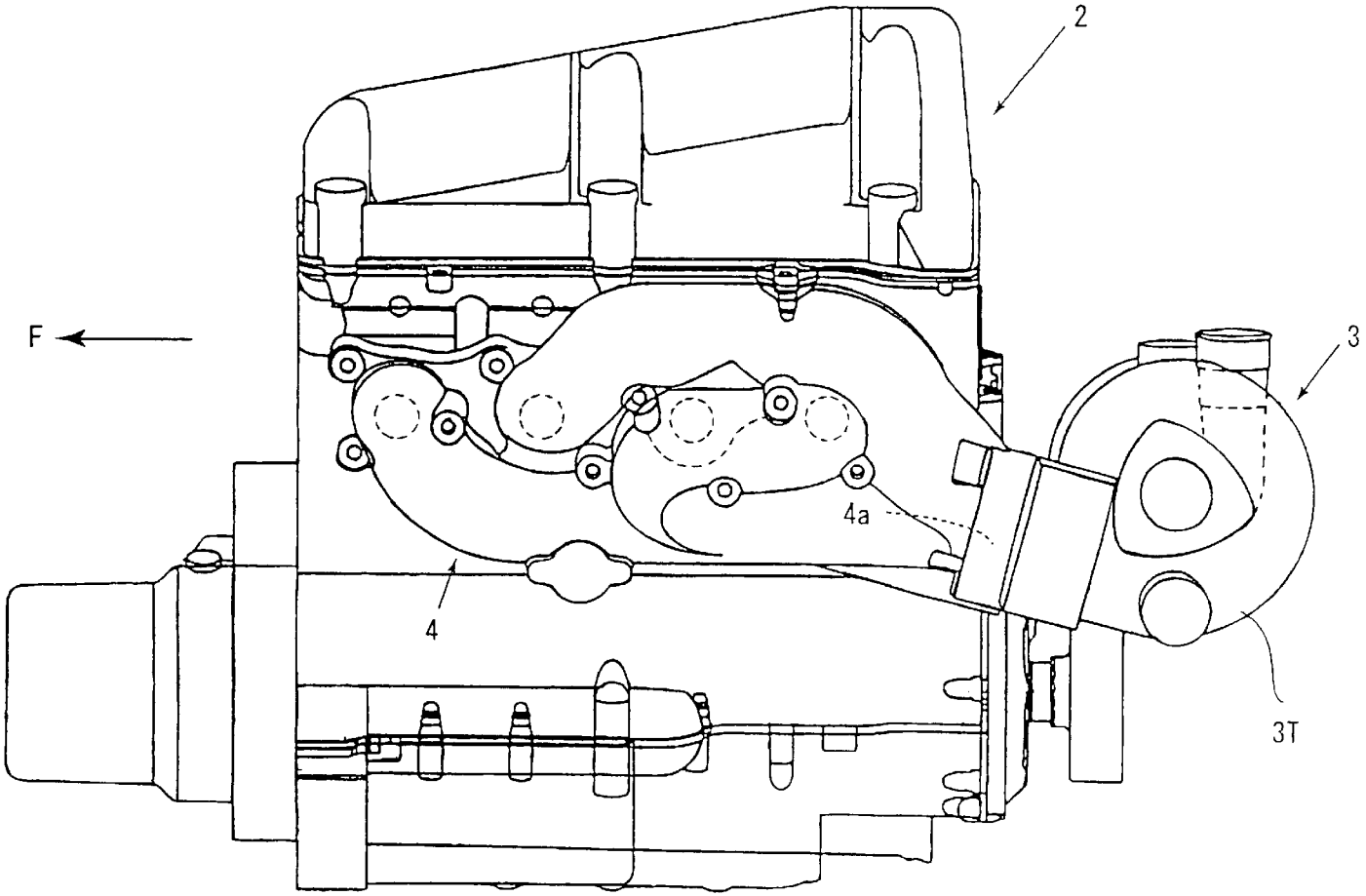
FIG. 13 PRIOR ART
FIG. 13 is an explanatory view of the prior art.
Figure 14:
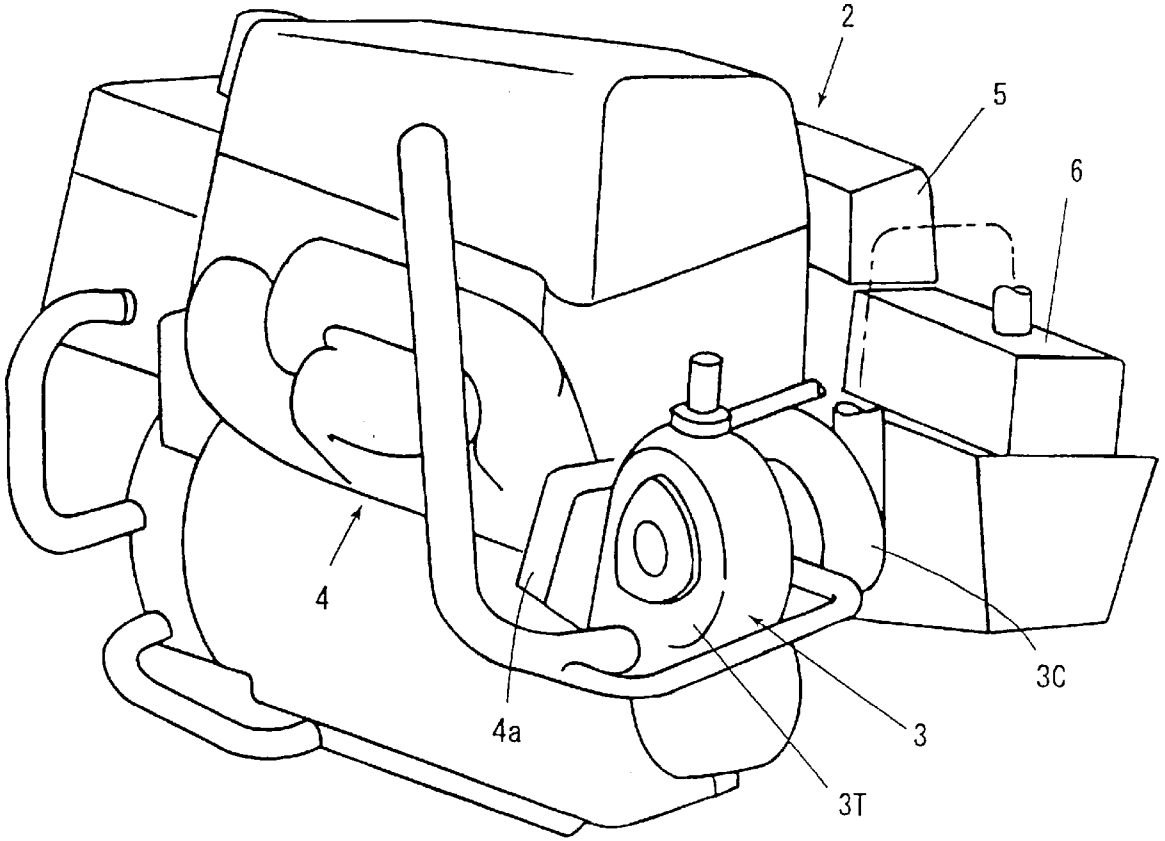
FIG. 14 PRIOR ART
FIG. 14 is an explanatory view of the prior art.

FIG. 10 is a sectional view of the turbocharger 140.

As described above, the turbocharger 140 includes the turbine portion 140T and the compressor portion 140C. The turbocharger 140 further includes a bearing casing 141 which interconnects the turbine portion 140T and the compressor portion 140C.

A bearing portion (accommodation chamber for a bearing member) 142 is provided in the bearing casing 141, and a turbine shaft 143 is supported for rotation by bearing members (ceramic ball bearings) 142*a* of the bearing portion 142.

Turbine blades 143T are secured to the turbine shaft 143 adjacent the turbine portion 140T, and compressor blades 143C are secured to the turbine shaft 143 adjacent the compressor portion 140C.

Accordingly, within a process wherein exhaust gas from the exhaust manifold 24 described hereinabove is exhausted from an exhaust gas exit T2 to the exhaust pipe 27*a* (refer to FIGS. 1 and 2) described hereinabove through an exhaust passage T1 in the turbine portion 140T, the turbine shaft 143 is driven to rotate, and the compressor blades 143C are driven to rotate so that air from an intake air inlet port C1 communicating with an intake box not shown is fed under pressure from the pipe 26 (refer to FIG. 7) to the intercooler 23 through an intake passage C2 in the compressor portion 140C.

An oil entrance 144 is provided at an upper portion of the bearing casing 141. The oil entrance 144 is in communication with the rear end portion 20*a*1 of the main gallery 20*a* by the pipe 25*a* (refer to FIG. 7) described hereinabove which services as an oil supply passage. The pipe 25*a* is connected to the oil entrance 144 by an orifice bolt 145.

An oil jacket 146 is formed inside of the bearing casing 141, and the oil entrance 144 described above is in communication with the oil jacket 146 by an oil passage 144*a*. The bearing portion 142 is in communication with the oil entrance 144 by a thin oil passage 144*b*.

Accordingly, oil entering from the oil entrance 144 is supplied from the oil passage 144*a* to the oil jacket 146 to cool the bearing casing 141, bearing portion 142, turbine shaft 143 and members around them, and is supplied from the oil passage 144*b* to the bearing portion 142 to lubricate the bearing portion 142.

The oil of the oil jacket 146 is recovered into the oil pan 28 from oil exits 146*a* and 146*b* of the oil jacket 146 through the pipes 25*b*, 25*c* (refer to FIG. 6) described hereinabove. Meanwhile, the oil of the bearing portion 142 once enters the oil jacket 146 from an exit 142*b* of the bearing portion 142 and then is recovered into the oil pan 28 from the oil exits 146*a* and 146*b* of the oil jacket 146 described above through the pipes 25*b*, 25*c* (refer to FIG. 6) described hereinabove.

The pipe 25*b* is connected to the oil exit 146*a*, and the pipe 25*c* is connected to the oil exit 146*b*.

The oil exits 146*a*, 146*b* are disposed higher than an oil surface O1 (refer to FIG. 6) when the engine stops.

Further, a one-way valve 147 is interposed in each of the pipes 25*b*, 25*c* which serve as an oil returning path.

As shown in FIG. 10, a water jacket T3 is formed in the casing of the turbine portion 140T. An entrance T4 for cooling water of the water jacket T3 is connected to the cooling water output port 30*a* (refer to FIG. 7) of the jet pump 30 described hereinabove by a pipe 148*a* which forms a different turbocharger cooling water passage independent of the other cooling water passages. Further, an exit (not shown) of the water jacket T3 for cooling water is connected to a water jacket of the exhaust pipe 27*a* (refer to FIGS. 1, 2) by a pipe 148*b* shown in FIG. 7.

Accordingly, cooling water from the jet pump 30 is supplied to the water jacket T3 of the turbocharger 140 directly without intervention of any other cooling device and cools the turbocharger 140. Whereafter, the water cools the exhaust pipe 27*a*. It is to be noted that the water having cooled the exhaust pipe 27*a* further flows into a water jacket of the backflow preventing chamber 27*b* to cool the backflow preventing chamber 27*b* and is then jetted into the water muffler 27*c*, whereafter it is discharged together with exhaust gas into water current produced by the jet pump 30 through the exhaust and drain pipe 27*d*.

According to such a turbocharger arrangement structure for a personal watercraft as described above, the following operation and effects are obtained.

The hull 14 and the deck 15 of the personal watercraft are formed watertight and the opening 15*a* of the deck 15 is closed up with the lid member 12 to form the body internal space 16. The intake ducts 18, 19 for introducing the atmospheric air from outside the body are provided in the space 16 and the engine 20 and the turbocharger 140 are connected to the exhaust manifold 24 of the engine 20 and are provided in the space 16. In addition, the turbocharger 140 is disposed higher than the body internal openings 18*a*, 19*a* of the intake ducts 18, 19. Therefore, when the atmospheric air outside the body is introduced into the body internal space 16 through the intake ducts 18, 19 during operation of the personal watercraft, even if it is introduced together with water (for example, in the form of droplets), such a situation that the turbocharger 140 becomes wet directly with the water becomes less likely to occur.

Accordingly, such a situation wherein the casing and so forth of the turbocharger 140 whose temperature is high are cooled suddenly becomes partially less likely to occur. In addition, and thermal fatigue becomes less likely to occur with the turbocharger 140. As a result, the durability of the turbocharger 140 is augmented.

The water jacket T3 is formed in the casing of the turbine portion 140T of the turbocharger 140 and the oil jacket 146 is formed in the bearing casing 141 for the turbocharger 140. Cooling water is supplied to the water jacket T3 and cooling oil is supplied to the oil jacket 146. Consequently, such a situation wherein the temperature of the turbocharger 140 becomes excessively high is eliminated.

Accordingly, when the atmospheric air outside the body is introduced into the body internal space 16 through the intake ducts 18, 19 during operation of the personal watercraft, even if the air is introduced together with water (for example, in the form of droplets) and the turbocharger 140 becomes exposed to the water, the temperature variation of the casing of the turbocharger 140 by the water is suppressed small.

As a result, thermal fatigue becomes less likely to occur with the turbocharger 140, and the durability of the turbocharger 140 is augmented with certainty.

Since cooling water for the water jacket T3 is supplied through the different turbocharger cooling water passage 148*a* independent of the other cooling water passages, the turbocharger 140 is cooled efficiently.

Accordingly, when the atmospheric air outside the body is introduced into the body internal space 16 through the intake ducts 18, 19 during operation of the personal watercraft, even if it is introduced together with water (for example, in the form of droplets) and the turbocharger 140 becomes exposed to the water, the temperature variation of the casing of the turbocharger 140 by the water is suppressed smaller.

As a result, thermal fatigue becomes further less likely to occur with the turbocharger 140, and the durability of the turbocharger 140 is augmented with a higher degree of certainty.

Since the cooling water from the turbocharger cooling water passage 148*a* is first supplied to the turbocharger 140 to cool the turbocharger 140 and is then supplied to the exhaust system (exhaust pipe 27*a*, backflow preventing chamber 27*b*, water muffler 27*c*, exhaust and drain pipe 27*d*) provided on the downstream with respect to the turbocharger 140 in the exhaust system for the engine 20, the turbocharger 140 can be cooled with cooling water in a state wherein the temperature is the lowest.

Accordingly, the turbocharger 140 can be cooled further efficiently and sufficiently.

Further, also the exhaust system provided downstream with respect to the turbocharger 140 can be cooled.

Since the cooling water having cooled the turbocharger 140 is discharged to the outside of the vessel 10 together with exhaust gas after it is supplied to the exhaust pipe 27*a* provided downstream with respect to the turbocharger 140 in the exhaust system, the exhaust gas which has driven the turbocharger 140 is further cooled in the exhaust pipe 27*a*.

In other words, the exhaust gas is cooled in the turbocharger 140 and the exhaust pipe 27*a*. Thus, the exhaust gas energy can be reduced synergetically, and as a result, the exhaust noise can be reduced.

Oil is supplied to the turbocharger 140 and the supplied oil is used to lubricate the bearing portion 142 of the turbocharger 140 and is supplied to the oil jacket 146 formed in the bearing casing 141 to cool the bearing casing 141. Thus, the turbocharger 140 is cooled even better.

The engine 20 is provided in the body 11 formed from the hull 14 and the deck 15 and the turbocharger 140 is provided for the engine 20 and the oil exits 146*a*, 146*b* of the turbocharger 140 are disposed higher than the oil surface O1 when the engine stops. If the engine 20 is stopped (accordingly if the operation of the oil pump 80 is stopped), then the oil in the turbocharger 140 is discharged quickly from the oil exits 146*a*, 146*b*.

If oil resides in the turbocharger 140 which has a high temperature immediately after the engine stops, then the resident oil is liable to be carbonized, and as a result, there is a problem that the entire oil which circulates in the engine 20 is liable to be degraded. However, with the personal watercraft 10 in which the engine with a turbocharger of the present embodiment is incorporated, if the engine 20 stops, then oil in the turbocharger 140 is discharged rapidly from the oil exits 146*a*, 146*b*, the oil which may reside in the turbocharger 140 after the engine stops can be minimized to reduce the degradation of all of the oil.

Since the engine 20 is a dry sump type engine and the oil tank 50 is provided on an extension line of the crankshaft thereof, the oil surface O1 when the engine stops can be set to be low.

Accordingly, oil in the turbocharger 140 is discharged quickly from the oil exits 146*a*, 146*b*, and as a result, the deterioration of the entire oil is further reduced.

Since the one-way valve 147 is interposed in each of the oil returning passages 25*b*, 25*c* is in communication with the oil exits 146*a*, 146*b* of the turbocharger 140, when the personal watercraft 10 capsizes, a situation wherein oil reversely flows from the oil pan 28 to the turbocharger 140 which is in a high temperature state and resides in the turbocharger 140 is eliminated.

Accordingly, carbonization of oil can be prevented with a higher degree of certainty, and degradation of all of the oil can be reduced with a higher degree of certainty.

Since the turbocharger 140 and an end portion of the main gallery 20*a* for oil is provided in parallel to the crankshaft 21 of the engine 20 that are in communication with each other by the oil supply passage 25*a*, oil to the turbocharger 140 is supplied from the end portion of the main gallery 20*a* to the turbocharger 140 directly through the oil supply passage 25*a*.

Accordingly, the time until oil is supplied to the turbocharger 140 after the engine is started is reduced. Thus, a quick and reliable operation of the turbocharger 140 can be achieved.

Since the oil pump 80 is provided on the front side of the body 11 with respect to the engine 20 while the turbocharger 140 is provided on the rear side of the body 11 and the turbocharger 140 and the rear end portion of the main gallery 20*a* are in communication with each other by the oil supply passage 25*a*, oil can be supplied rapidly to the turbocharger 140 rearwardly of the engine.

Since oil supplied to the turbocharger 140 is used to lubricate the bearing portion 142 of the turbocharger 140 and is supplied to the oil jacket 146 formed in the bearing casing 141 to cool the bearing casing 141, not only can the bearing portion 142 of the turbocharger 140 be lubricated but also the bearing casing 141 can be cooled.

Further, where lubrication of the bearing portion 142 of the turbocharger 140 and cooling of the bearing casing 141 are performed with oil supplied to the turbocharger 140 in this manner, it is necessary to quickly supply a greater amount of oil than ever to the turbocharger 140. However, with the turbocharger cooling structure 10 for a personal watercraft of the present embodiment, since the oil to the turbocharger 140 is supplied from the end portion of the main gallery 20*a* directly to the turbocharger 140 through the oil supply passage 25*a*, a greater amount of oil can be supplied rapidly.

While an embodiment of the present invention is described above, the present invention is not limited to the embodiment described above but can be carried out suitably in various forms within the scope of the subject matter of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbocharger arrangement structure for a personal watercraft comprising:

a hull and a deck forming a watertight personal watercraft;

an opening formed in said deck;

a lid member for closing said opening to form a body internal space;

an intake duct for introducing atmospheric air from outside said body is provided in said space; and an engine and a turbocharger connected to an exhaust manifold of said engine are provided in said space;

wherein said turbocharger is disposed higher than a body internal opening of said intake duct.

2. The turbocharger arrangement structure for a personal watercraft according to claim 1, wherein a water jacket is formed in a casing of a turbine portion of said turbocharger and an oil jacket is formed in a bearing casing of said turbocharger, and cooling water is supplied to said water jacket and cooling oil is supplied to said oil jacket.

3. The turbocharger arrangement structure for a personal watercraft according to claim 2, wherein the cooling water to said water jacket is supplied by a distinct turbocharger cooling water passage independent of any other cooling water passage.

4. The turbocharger arrangement structure for a personal watercraft according to claim 2, wherein cooling water is supplied to the turbocharger directly without an intervention from any other cooling devices.

5. The turbocharger arrangement structure for a personal watercraft according to claim 2, wherein cooling water is connected to a water jacket of an exhaust pipe for cooling the exhaust pipe.

6. The turbocharger arrangement structure for a personal watercraft according to claim 1, wherein mounting said turbocharger at a higher position relative to the internal opening of the intake duct prevents the turbocharger from being exposed to water droplet in the atmospheric air.

7. The turbocharger arrangement structure for a personal watercraft according to claim 1, wherein said turbocharger is positioned to the rear of the engine.

8. A turbocharger arrangement structure for a personal watercraft comprising:

a hull and a deck forming a watertight personal watercraft;

an opening formed in said deck;

a lid member for closing said opening to form a body internal space;

an intake duct for introducing atmospheric air from outside said body is provided in said space; and an engine operatively mounted within said space for propelling said watercraft;

an exhaust manifold for said engine; and a turbocharger operatively connected to the exhaust manifold of said engine, said turbocharger being mounted to a rear portion of the engine;

wherein said turbocharger is disposed higher than a body internal opening of said intake duct.

9. The turbocharger arrangement structure for a personal watercraft according to claim 8, wherein a water jacket is formed in a casing of a turbine portion of said turbocharger and an oil jacket is formed in a bearing casing of said turbocharger, and cooling water is supplied to said water jacket and cooling oil is supplied to said oil jacket.

10. The turbocharger arrangement structure for a personal watercraft according to claim 9, wherein the cooling water to said water jacket is supplied by a distinct turbocharger cooling water passage independent of any other cooling water passage.

11. The turbocharger arrangement structure for a personal watercraft according to claim 9, wherein cooling water is supplied to the turbocharger directly without an intervention from any other cooling devices.

12. The turbocharger arrangement structure for a personal watercraft according to claim 9, wherein cooling water is connected to a water jacket of an exhaust pipe for cooling the exhaust pipe.

13. The turbocharger arrangement structure for a personal watercraft according to claim 8, wherein mounting said turbocharger at a higher position relative to the internal opening of the intake duct prevents the turbocharger from being exposed to water droplet in the atmospheric air.

* * * * *